US006338785B1

(12) United States Patent
de Nora et al.

(10) Patent No.: US 6,338,785 B1
(45) Date of Patent: Jan. 15, 2002

(54) START-UP OF ALUMINUM ELECTROWINNING CELLS

(75) Inventors: Vittorio de Nora, Nassau (BS); Jainagesh Akkaraju Sekhar, Cincinnati, OH (US); Jean-Jacques Duruz, Geneva (CH); James Jeng Liu, Cincinnati, OH (US)

(73) Assignee: Moltech Invent S.A., Luxembourg ( * ) Notice: Subject to any disclaimer, the term of this patent is extended or adjusted under 35 U.S.C. 154(b) by 0 days.

(21) Appl. No.: 09/290,766

(22) Filed: Apr. 13, 1999

Related U.S. Application Data

(63) Continuation-in-part of application No. PCT/US97/19141, filed on Oct. 17, 1997.

(51) Int. Cl.[7] ..... C25C 3/06; B05D 3/02
(52) U.S. Cl. ..... 205/390; 427/372.2
(58) Field of Search ..... 205/390, 381, 205/372, 232, 233, 230, 224; 204/247.4; 427/372.2; 156/60

(56) References Cited

U.S. PATENT DOCUMENTS 4,093,524 A * 6/1978 Payne ..... 205/114

5,352,338 A * 10/1994 Juric et al. ..... 205/390

* cited by examiner

*Primary Examiner*—Donald R. Valentine
(74) *Attorney, Agent, or Firm*—Jayadeep R. Deshmukh

(57) ABSTRACT

A method of protecting a cathode during the start-up procedure of an aluminum electrowinning cell where the cathode is optionally coated with an aluminium-wettable refractory material and when in use, aluminium is produced thereon. The start-up procedure comprises applying, before preheating the cell, one or more start-up layers in intimate contact on the aluminium-wettable refractory coating which form(s) a temporary protection against damage of chemical and/or mechanical origin to the aluminium-wettable coating; this temporary protection being eliminated before or during the initial normal cell operation. The temporary protection layers may be obtained from at least one pliable aluminium foil having a thickness of less than 0.1 mm and/or an applied aluminium-containing metallization, optionally in combination with inter alia a boron-containing solution, a polymer, a phosphates of aluminium-containing solution, or a colloid that gels while preheating the cell, or combinations thereof.

49 Claims, 1 Drawing Sheet

START-UP OF ALUMINUM ELECTROWINNING CELLS

This application is a continuation-in-part of PCT/US97/19141, filed Oct. 17, 1997.

FIELD OF THE INVENTION

The invention relates to the starting up of cells for the electrowinning of aluminium by the electrolysis of alumina in a cryolite-based melt, which cell comprises a conductive cell bottom on which, in use, aluminium is produced and forms a layer or pool atop which is the molten cryolite electrolyte. The invention is particularly but not exclusively concerned with the start up of such cells where the cathode surface is protected by an aluminium-wettable refractory coating.

BACKGROUND OF THE INVENTION

Aluminium is produced conventionally by the Hall-Héroult process, by the electrolysis of alumina dissolved in cryolite-based molten electrolytes at temperatures up to around 950° C. A Hall-Héroult reduction cell typically has a steel shell provided with an insulating lining of refractory material, which in turn has a lining of carbon which contacts the molten constituents. Conductor bars connected to the negative pole of a direct current source are embedded in the carbon cathode substrate forming the cell bottom floor. The cathode substrate is usually an anthracite based carbon lining made of prebaked cathode blocks, joined with a ramming mixture of anthracite, coke, and coal tar or resins.

In Hall-Héroult cells, a molten aluminium pool acts as the cathode. The carbon lining or cathode material has a useful life of three to eight years, or even less under adverse conditions. The deterioration of the cathode bottom is due to erosion and penetration of electrolyte and liquid aluminium as well as intercalation or sodium, which causes swelling and deformation of the cathode carbon blocks and ramming mix. In addition, the penetration of sodium species and other ingredients of cryolite or air leads to the formation of toxic compounds including cyanides.

When they are put into service, aluminium electrowinning cells must be preheated. When the cell has reached a sufficient temperature, molten cryolite electrolyte is added and the start-up is continued until the cell reaches an equilibrium operating condition.

One known cell start-up procedure comprises applying a layer of coke or similar conductive material to the cell bottom and passing an electric current via anodes and through the coke into the cell bottom to heat the cell by the Joule effect. Another known cell start-up procedure uses flame burners. In U.S. Pat. No. 4,405,433 (Payne), it has been suggested that refractory fibrous materials of aluminium silicate be placed over refractory hard metal cathode assemblies prior to preheating of the cathode assemblies.

U.S. Pat. No. 5,651,874 (Sekhar/de Nora) has proposed coating the carbon cell bottom with particulate refractory hard material in a colloidal carrier to produce a hard adherent aluminium-wettable surface coating. These aluminium-wettable refractory coatings have by far outperformed all previous attempts to use such materials to protect carbon cell bottoms.

To facilitate cell start up, in particular when using these improved coatings, it has already been proposed to place an aluminium sheet on top of the coating before preheating (see Cathodes in Aluminium Electrolysis, 2nd Edition, 1994, M. Sorlie and H. Oye, published by Aluminium Verlag, page 70). The purpose of this aluminium sheet was to avoid possible hot-spots due to uneven current distribution. Because of the high current densities employed and the need to ensure an even heat distribution, aluminium sheets with a thickness of 1 to 5 mm were used. This aluminium sheet melts during the start-up procedure and is integrated into the pool of product aluminium.

However, it has been found that whereas use of such aluminium sheets has been effective in reducing hot-spots, they do not protect against oxidation of the cathode. The use of thick aluminium sheets has not addressed this problem.

SUMMARY OF THE INVENTION

It is therefore an object of the invention to provide a start-up procedure which is entirely reliable as regards the avoidance of any damage to the cathode surface by using a material which when applied to the cathode forms a thin and uniform protective layer.

Another object of the invention is to protect the cathode by covering it with a temporary protective material before preheating the cell. A further object of the invention is to provide a temporary protective material which is at least partially eliminated by the beginning of normal use of the cell, such that it does not contaminate the product aluminium with the temporary protective material.

The invention in particular relates to a method of starting-up a cell for the electrowinning of aluminium by the electrolysis of alumina dissolved in a fluoride-based melt such as cryolite, the cell comprising a cathode on which, in use, aluminium is produced and forms a layer or pool. The start-up method comprises applying one or more aluminium-containing start-up layers on the cathode surface followed by preheating the cell, the start-up layers temporarily protecting the cathode surface during start-up.

The method of the invention comprises applying at least one pliable foil of aluminium which comes into and remains in intimate matching contact with the cathode surface during preheating the cell and/or applying at least one aluminium-containing metallization which is applied and remains in intimate matching contact with the cathode surface during preheating the cell. The start-up layer(s) temporarily protect (s) the cathode against chemical attack by reaction with gases and/or fluids such as melting electrolyte during cell start-up.

The start-up layer(s) form(s) a temporary protection against damage of chemical or chemical/mechanical origin to the cathode, this temporary protection being in intimate contact with the cathode surface and being usually at least partly eliminated before or during the initial normal operation of the cell. The temporary protection may be "washed away" by normal operation of the cell or permanently integrated into the cathode surface.

In contrast to the prior art, the temporary protection remains in intimate contact with the cathode surface below a layer of molten aluminium during the cell start-up. When only a thick sheet of aluminium is applied on the cell bottom, the applied layer melts during start-up and is merely integrated to the pool of product aluminium without preventing melting electrolyte from attacking the aluminium-wettable coating.

For the purpose of this invention, start-up layers may for example be obtained from the following materials: at least one pliable foil of aluminium having a thickness of less than 0.1 mm; and/or an applied metallization of aluminium or an alloy or an intermetallic compound comprising aluminium and at least one further metal selected from nickel, iron, titanium, cobalt, chromium, vanadium, zirconium, hafnium, niobium, tantalum, molybdenum, cerium and copper.

In combination with the aluminium-containing start-up layers, additional start-up layers may be used such as:

a) a boron-containing solution forming a glassy layer;

b) a polymer or a polymer precursor;

c) a solution containing phosphates of aluminium;

f) a colloid; and combinations of the aforesaid.

Normally the cell bottom is made of carbonaceous material such as carbon blocks. The cathode mass can be made mainly of carbonaceous material, such as compacted powdered carbon, a carbon-based paste for example as described in U.S. Pat. No. 5,362,366 (Sekhar et al), prebaked carbon blocks assembled together on the shell, or graphite blocks, plates or tiles.

It is also possible for the cathode to be made mainly of an electrically-conductive carbon-free material, of a composite material made of an electrically-conductive material and an electrically non-conductive material, or of an electrically non-conductive material.

Such non-conductive carbon-free materials can be alumina, cryolite, or other refractory oxides, nitrides, carbides or combinations thereof and the conductive materials can be at least one metal from Groups IIA, IIB, IIIA, IIIB, IVB, VB and the Lanthanide series of the Periodic Table, in particular aluminium, titanium, zinc, magnesium, niobium, yttrium or cerium, and alloys and intermetallic compounds thereof.

The composite material's metal preferably has a melting point from 650° C. to 970° C.

The composite material is advantageously a mass made of alumina and aluminium or an aluminium alloy, see U.S. Pat. No. 4,650,552 (de Nora et al), or a mass made of alumina, titanium diboride and aluminium or an aluminium alloy.

The composite material can also be obtained by micropyretic reaction such as that utilizing, as reactants, $TiO_2$, $B_2O_3$ and Al.

The cathode can also be made of a combination of at least two materials from : at least one carbonaceous material as mentioned above; at least one electrically conductive non-carbon material; and at least one composite material of an electrically conductive material and an electrically non-conductive material, as mentioned above.

Advantageously the cathode surface is coated with an aluminium-wettable refractory material, such as a refractory hard metal boride. Particulate refractory hard metal boride may for instance be included in a colloidal carrier and then applied to the cathode surface, i.e. according to the teaching of the aforesaid U.S. Pat. No. 5,651,874 (Sekhar/de Nora).

When an aluminium foil is used as a start-up layer, the foil is preferably from 0.03 to 0.05 mm thick. Eventually, the foil may be oxidised during heating and incorporated (as alumina) into the cathode surface or into a coating of aluminium-wettable refractory material.

The protection involving aluminium foils is contrasted with the use of a thick aluminium sheet, known from the prior art, which helps to avoid possible hot-spots due to uneven current distribution. Thick sheets of aluminium cannot be in intimate contact with the cathode surface because of their poor malleability and therefore cannot sufficiently protect the cathode from fluid and/or gaseous attack during start-up. Such thick sheets of aluminium merely ensure a good current distribution to avoid hot-spots. In contrast, thin foils of aluminium intimately match the surface of the cathode which may be porous and protect the cathode from undesired attacks during preheating of the cell.

However, as explained below, it is possible to use a thick aluminium sheet in combination with a protective layer according to the invention, e.g. including aluminium foils.

As stated above, an aluminium-containing metallization may be used in order to protect the cathode surface. The metallization, which can be intimately bonded to the cathode surface, combines chemical, mechanical and electrical properties useful for the start-up procedure. This type of start-up layer prevents damage to the cathode of chemical and/or mechanical origin and additionally, the good conductivity of the material may be advantageously used during the cell heating procedure when achieved by the Joule effect as described hereafter. Typical metals which may be used for a metallization are aluminium, or an alloy or intermetallic compound comprising aluminium and at least one further metal selected from nickel, iron, titanium, cobalt, chromium, vanadium, zirconium, hafnium, niobium, tantalum, molybdenum, cerium and copper.

The use of metallic paints obtained from metallic powder applied in an aqueous, non-aqueous liquid or in an aqueous liquid containing organics, in particular in a polymer, such as polyurethane, ethylene glycol, polyethylene glycol, resins, esters or waxes may be very convenient due to their good protective properties and the ease with which such a material may be applied on the surface of the cell bottom.

Generally, the constituents and the amount of the protective metallization will be chosen so that there is an adequate protection during cell start-up but no undesirable contamination of the aluminium produced. Such metallization may also assist wetting of a porous refractory surface with molten aluminium. The protective metallization will usually not remain permanently on the surface of the cathode but will be either "washed away" or integrated into the surface of the cathode by the time the cell reaches its normal steady state operation.

For instance an aluminium paint can be applied on the cell bottom and then covered with a plurality of foils of aluminium as described above.

Advantageously intermetallic compounds may be used to protect the cell bottom. These compounds may comprise aluminium with a further material selected from nickel, iron, titanium, cobalt, chromium, zirconium or combinations thereof. Furthermore such a layer of intermetallic compound is advantageously formed by applying on top of the cell bottom a combination of either aluminium powder, sheet, mesh or porous body such as foam on top of a sheet, mesh or porous body of said further material, or vice-versa. Heating the two metals before or during preheating of the cell initiates a spontaneous reaction for the production of an intermetallic component. Normally, such a layer is then evacuated with the produced molten aluminium before or during the initial normal operation of the cell.

The use of NiAl or $Ni_3Al$ as an intermetallic layer is particularly beneficial. For instance, NiAl is remarkably stable when exposed to heat, the melting point being at about 1600° C. Additionally it presents good mechanical characteristics.

An additionally applied protective start-up layer on the cathode surface may be obtained at least partly from a boron-containing solution that forms a glassy layer. The boron solution can be made from boron oxide, boric acid or tetraboric acid in an aqueous, non-aqueous or aqueous containing organics solvent such as methanol, ethylene glycol, glycerine, water or mixtures thereof. Optionally, the solution may comprise particulate metal that enhances the conductivity of the layer. Good results were obtained where a mix of aluminium and optionally borides and/or carbides of metals from the group comprising aluminium, titanium, chromium, vanadium, zirconium, hafnium, niobium, tantalum, molybdenum and cerium were added to the solution. Application of a boron-containing layer covered with a plurality of aluminium foils was successfully tested as well.

Alternatively a further applied protective start-up layer on the cathode surface may be obtained at least partly from a polymer or polymer precursor, such as polyurethane, ethylene glycol, polyethylene glycol, resins, esters or waxes. As described above, the electrical conductivity of such a layer may be enhanced by adding particulate conductive material, optionally mixed with borides and/or carbides.

A further alternative is to form an additional protective start-up layer on the cathode surface from an aqueous and/or non-aqueous solution containing phosphates of aluminium, such as monoaluminium phosphate, aluminium phosphate, aluminium polyphosphate, aluminium metaphosphate and mixtures thereof, for instance dissolved in water. Such a protective start-up layer is advantageously covered with a plurality of foils of aluminium as described above.

When an additional protective start-up layer is obtained at least partially from a colloid solution, the colloid is preferably selected from colloidal alumina, silica, yttria, ceria, thoria, zirconia, magnesia, lithia, monoaluminium phosphate, cerium acetate or a mixture thereof. The colloid solution usually gels during preheating of the cell and protects the cathode and if present the aluminium-wettable refractory coating during this critical start-up phase. Optionally, the colloid from the start-up layer may be at least partially incorporated into the cathode surface or the aluminium-wettable coating.

Such an additional protective start-up layer advantageously contains a particulate conductor, such as particulate aluminium, nickel, iron, titanium, cobalt, chromium, zirconium, copper and combinations thereof, in order to improve the conductivity of the start-up layer and additionally to avoid uneven current distribution. Likewise, a protective start-up layer comprising colloidal alumina can be used in combination with at least one pliable foil of aluminium having a thickness of less than 0.1 mm. For instance one or more aluminium foils can be sandwiched with the colloidal alumina.

As previously described, protective material is either intimately merged or is in intimate contact with the porous surface of the aluminium-wettable refractory coating and may be partly (or wholly) permanently incorporated in this coating, or partly or wholly removed as the cell reaches its steady state operation.

Additives such as particulate aluminium, or borides and/or carbides may be added to any protective start-up layer described hereabove before preheating the cell. Such addition enhances the protective effect of the temporary protection. The borides and/or carbides may be selected from the following metals: aluminium, titanium, chromium, vanadium, zirconium, hafnium, niobium, tantalum, molybdenum and cerium.

Similarly, pliable foils or thick sheets of aluminium may be added on top of any protective start-up layer described hereabove.

In the method of the invention, heat can be generated in the conductive material to preheat the cell bottom by passing electric current via anodes and through conductive material such as resistor coke into the cell bottom to heat the cell by the Joule effect.

For this configuration the temporary protection preferably has good electrical conductivity. The conductivity of a layer may however be enhanced by adding conductive material as described above. For instance aluminium powder may be incorporated to a non-inherently conductive or poorly conductive material and therefore even thick layers of poorly conductive based material may be used.

When this electrical resistance preheating is used, a relatively thick sheet or sheets of aluminium, usually from 1 to 5 mm thick, preferably 3 to 5 mm, can placed between each anode and the temporary protection, in particular on top of the temporary protection. This thick sheet of aluminium, as is known, serves to assist the distribution of the electrical current evenly, and hence avoid hot-spots.

Alternatively, the cell bottom can be flame preheated by burners providing precautions are taken to avoid direct contact of the flame with a thin protective start-up layer, e.g. by covering it with a layer of coke or other heat-conductive material. This method offers the advantage of not being dependent upon the electrical conductivity of the materials involved.

Another method to heat the cell during the start-up procedure, which is not dependent upon the material involved, involves radiation techniques. A light source may be used in order to transfer heat to the cell in form of light waves. The preferred emitted wavelengths correspond to the infrared spectrum. This technique offers the advantage of avoiding pollution of the cell with undesired elements as when using the flame or the carbon resistor technique.

Furthermore, the layer of coke or other conductive material can be mixed with and/or covered with a halide-based electrolyte having a point of fusion in the region 660°–760° C. Molten cryolite is added to the cell when the temperature of the cell exceeds the point of fusion of said halide-based electrolyte added to the conductive material. This halide-based electrolyte can be mixed with or covered with a layer of conductive material such as coke.

Optionally protective start-up layers may extend to cover other components, such as cell side walls. The protection may even extend above the level of the fluoride-based melt reached during normal use of the cell.

Several methods are available in order to apply protective start-up layers on the cell bottom. When the precursor of a layer is of liquid form various painting methods may be applicable such as using brushes, rollers or spraying techniques. In case of a metallization hot-spraying may be used to apply molten metal.

Vapour deposition techniques such as chemical vapour deposition (CVD) or physical vapour deposition (PVD) may be used, or plasma spraying. Chemical or electro-deposition may be advantageously used considering the electrolytic cell environment.

When a foil is included in the protective layer, such as an aluminium foil, it can be secured on the cell bottom using adhesive application or hot-pressing which gives good results in case of powdery precursors as well.

All these techniques for applying the temporary protection on the cell bottom may be advantageously done using an automatic device like for instance an apparatus as described in international application WO98/20188 (Sekhar/Berclaz). However, other types of system may be envisaged, like an angular (cylindrical or SCARA) or a parallel type robot. Partly automated system may also be used.

The invention also relates to a method of electrowinning aluminium. The method comprises two steps namely a start-up procedure with a temporary protection as described hereabove followed by the production of aluminium.

The fluoride-based melt is usually operated at a temperature comprised between 700° and 970° C.

Aluminium may be produced by using oxygen-evolving non-carbon anodes, in particular metal-based anodes, as for instance disclosed in co-pending applications PCT/IB99/00017 and PCT/IB99/00018 having an oxide based electrochemically active surface, such as a hematite coating which may be maintained dimensionally stable as disclosed in co-pending applications U.S. Ser. No. 09/126,839, PCT/IB99/00015 and PCT/IB99/00016. As described in these references, the fluoride-based melt is preferably operated at reduced temperature, i.e. between 750° and 850° C., to limit contamination of the melt and of produced aluminium by anode constituents.

The above described method is suitable for conventional Hall-Héroult aluminium production cells. However, it can also be utilised for advanced cell designs, in particular designs incorporating an aluminium-wettable drained cathode, as disclosed U.S. Pat. No. 5,683,559 and in co-pending application PCT/IB99/00222 and/or in cells operating without electrolyte crust, for instance fitted with an insulating cover as disclosed in co-pending application WO99/02763.

DETAILED DESCRIPTION

Figure 1:
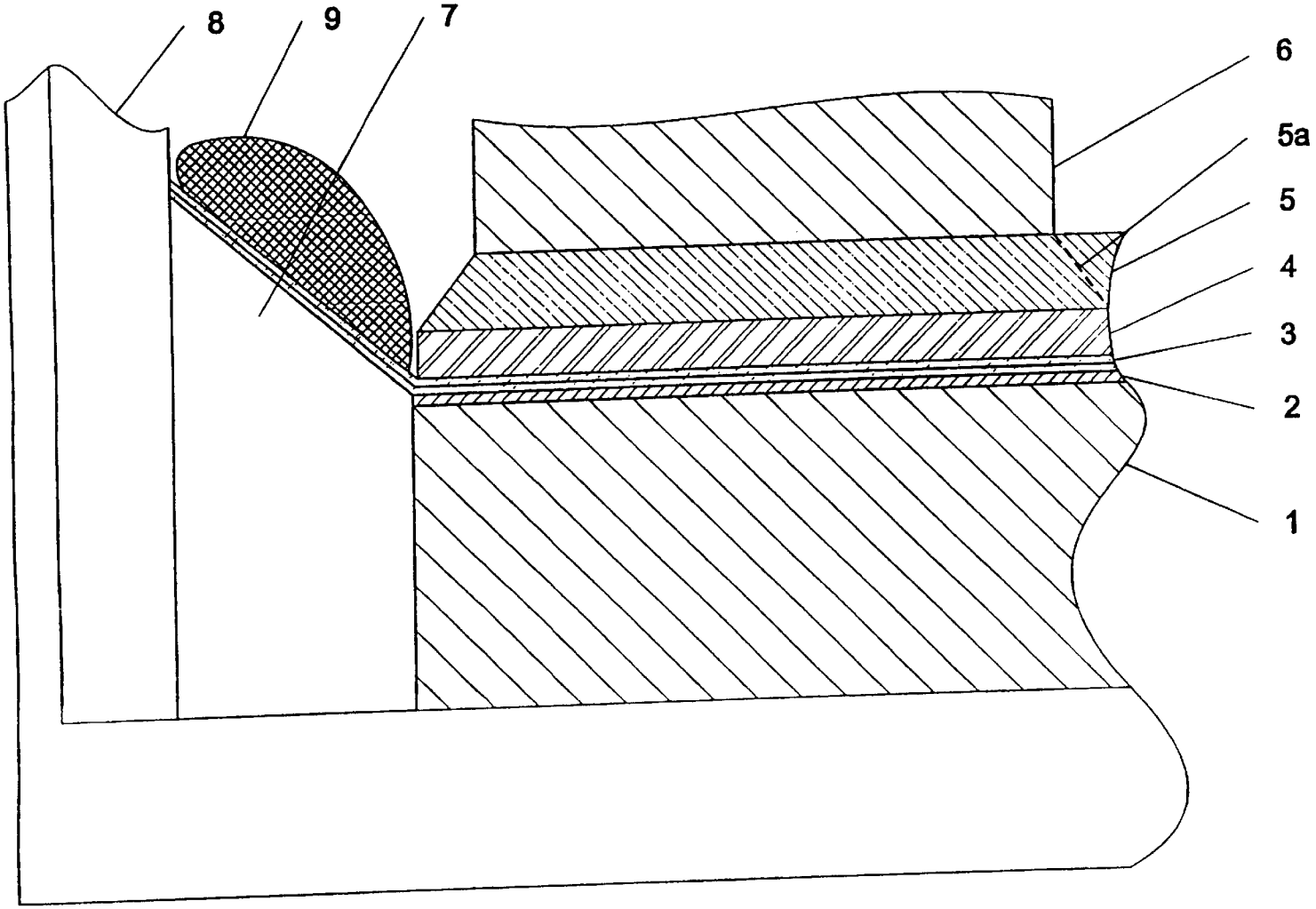
FIG. 1 is a schematic view of part of a cell for the electrowinning of aluminium arranged for carrying out the start-up procedure of the present invention.

FIG. 1 shows part of an aluminium electrowinning cell comprising a cathode cell bottom 1, for example carbon, coated with an aluminium-wettable refractory material 2, in particular a slurry-applied titanium diboride coating as described in U.S. Pat. No. 5,651,874 (Sekhar/de Nora). The coating 2 is covered with a temporary protection 3, for example a couple of thin aluminium foils each having a thickness of 0.04 mm, against damage of chemical and/or mechanical origin to the aluminium-wettable coating 2 during the start-up procedure. Alternatively, other protective layers can be applied, for example those described in Examples II to V below. On the temporary protection 3 a thick sheet of aluminium 4 (i.e. having a thickness of 4 mm) is applied. The aluminium sheet 4 is covered with resistor coke 5 up to the bottom of the anode 6 which is facing the cathode. The resistor coke 5 may extend along the temporary protection or be confined under the anode 6 as indicated by the dashed line 5*a*. The temporary protection 3 extends up a wedge 7 connecting the cathode cell bottom 1 to the cell side wall 8 on which frozen alumina-containing cryolite 9 is located. The temporary protection 3 and the aluminium sheet 4 are shown out of proportion in FIG. 1.

When current is passed from the anode 6 to the cathode 1 via the resistor coke 5 and the thick aluminium sheet 4 and aluminium foils 3 heat is generated mainly in the resistor coke 5. The thick aluminium sheet 4 helps to avoid hot-spots as described in the prior art. The heat generated in the resistor coke 5 enables first the aluminium sheet 4 and foils 3 and then the frozen cryolite 9 to melt and fill the cell. The presence of the thin foils of aluminium 3 which come into intimate contact with the aluminium-wettable coating 2 while preheating the cell prevents melting cryolite from coming into contact with the coating 2.

When molten cryolite fully covers the cell bottom up to the level of the anode bottom 6 electrolysis of alumina dissolved in the molten cryolite may begin. The evacuation of free elements originating from the thin foils of aluminium 3, the aluminium sheet 4 and the resistor coke 5 takes place before or during initial normal operation of the cell.

The feasibility of the invention has been demonstrated in the following laboratory tests:

EXAMPLE I

In order to show the oxidation of $TiB_2$ into $TiO_2$ and $B_2O_3$, when applied in a colloid onto the cell bottom, the following laboratory test was carried out.

Platelets (about 20×40×3 mm) of an aluminium-wettable refractory coating material were prepared by slip casting of a slurry made of 14 ml of colloidal alumina, 12 ml of colloidal silica and 50 g of $TiB_2$ powder on a porous plaster substrate.

One platelet was weighed, subjected to a heat treatment in air at 800° C. for 15 hours in a box furnace and weighed again after cooling. Under these conditions, which simulate the oxidising conditions during cell-start-up the weight uptake resulting from oxidation of the $TiB_2$ components to form $TiO_2$ and $B_2O_3$ was 0.69 g or about 12% of total $TiB_2$ content.

EXAMPLE II

A similar procedure was carried out as in the previous example but with the $TiB_2$ coating protected by foils of aluminium.

A platelet as in Example I was wrapped in three layers of aluminium foil (0.02 mm thickness) and submitted to the same treatment as for the previous example. The weight uptake, taking into consideration the oxidation of the aluminium, was found to be 5%, therefore demonstrating the efficiency of the protective layer against oxidation.

EXAMPLE III

In order to demonstrate the effectiveness of a protective layer originating from an aluminium paint the following test was carried out.

A platelet as in Example I was metallized on all its surface by spraying an aluminium powder (<1 $\mu$m) in suspension in an organic carrier and synthetic resin three times, allowing each layer to dry at room temperature until a layer of about 80–100 $\mu$m was obtained. The coated sample was submitted to the same treatment as in the first example. The weight uptake, taking into consideration the oxidation of aluminium, was found to be 2%, therefore demonstrating the efficiency of the protective layer against oxidation.

EXAMPLE IV

Furthermore, the efficiency of a combination of an aluminium foil and a polymer was tested in a similar way as in the preceding examples.

A platelet as in Example I was coated by brushing on all its surface with one layer of polyurethane in an organic solvent and an aluminium foil (0.06 mm thickness) was applied on top immediately after, so that the aluminium foil was firmly fixed after the polyurethane solution has dried out. The coated sample was submitted to the same heat treatment as for Example I. The weight uptake was found to be 0.5%, therefore demonstrating the efficiency of this protective layer against oxidation.

It will be understood that modifications may be made in the present invention without departing from the spirit of it. Thus, the scope of the present invention should be considered in terms of the following claims, and is understood not to be limited to the details of operation described in the specification.

EXAMPLE V

Finally, the efficiency of a combination of an aluminium foil with an aluminium paint was tested.

The platelet of Example I was metallized as in Example 3 on all its surface by spraying a paint of aluminium powder (<1 μm) in suspension in an organic carrier and synthetic resin three times, allowing each layer to dry at room temperature until a layer of about 80–100 μm was obtained. An aluminium foil (0.06 mm thickness) was applied thereon immediately after the last layer of paint was sprayed, so that the aluminium foil was firmly fixed after the last paint layer had dried out.

The coated sample was submitted to the same treatment as in the first example. The weight uptake, taking into consideration the oxidation of aluminium, was found to be less than 2%, therefore demonstrating the efficiency of the protective layer against oxidation.

What is claimed is:

1. A method of starting-up a cell for the electrowinning of aluminium by the electrolysis of alumina dissolved in a fluoride-based melt, the cell comprising a cathode on which, in use, aluminium is produced and forms a layer or pool, said method comprising the steps of:

applying one or more aluminium-containing start-up layers on the cathode surface to protect temporarily the cathode surface during start-up, said applied start-up layer(s) comprising at least one of a pliable foil of aluminium having a thickness of from 0.03 to 0.1 mm, which comes into and remains in intimate matching contact with the cathode surface during preheating the cell and an aluminium-containing metallization which is applied to and remains in intimate matching contact with the cathode surface during preheating the cell; and preheating the cell, the cathode being temporarily protected by the start-up layer(s) against chemical attack by reaction with gases and/or fluids such as melting electrolyte during the preheating of the cell.

2. The method of claim 1, wherein the start-up layer(s) on the cathode is/are eliminated by washing away the start-up layer(s) and/or permanently integrating at least part of the start-up layer(s) into the cathode surface by normal steady state operation of the cell.

3. The method of claim 1, wherein the cathode is made of carbonaceous material, electrically conductive carbon-free material, electrically non-conductive carbon-free material, or combinations thereof.

4. The method of claim 1, comprising applying the start-up layer(s) on a coating of aluminium-wettable refractory material forming the cathode surface.

5. The method of claim 4, wherein the aluminium-wettable refractory coating comprises refractory hard metal boride.

6. The method of claim 5, wherein the aluminium-wettable refractory coating comprises particulate refractory hard metal boride in a colloidal carrier.

7. The method of claim 4, wherein the aluminium-wettable refractory coating protected by at least one start-up layer is covered with a fluoride-based melt having a point of fusion in the region 660°–760° C., said fluoride-based melt being added to the cell when the temperature of the cell exceeds the point of fusion of said fluoride-based melt added to the conductive material.

8. The method of claim 1, wherein said pliable aluminium foil is from 0.03 to 0.05 mm thick.

9. The method of claim 8, wherein said pliable aluminium foil is at least partly oxidised and at least partly incorporated into the cathode surface as alumina.

10. The method of claim 1, comprising applying a metallization of aluminium or an alloy or an intermetallic compound comprising aluminium and at least one further metal selected from nickel, iron, titanium, cobalt, chromium, vanadium, zirconium, hafnium, niobium, tantalum, molybdenum, cerium and copper.

11. The method of claim 10, wherein said metallization is obtained from metallic powder(s) applied in an aqueous or non-aqueous liquid, or in an aqueous liquid containing organics.

12. The method of claim 11, wherein the liquid is a polymer, such as polyurethane, ethylene glycol, polyethylene glycol, resins, esters or waxes.

13. The method of claim 10, wherein the metallization is an intermetallic compound comprising aluminium and at least one further metal selected from nickel, iron, titanium, cobalt, chromium and zirconium.

14. The method of claim 13, wherein said intermetallic compound is NiAl or $Ni_3Al$.

15. The method of claim 13, wherein said intermetallic compound is obtained by applying aluminium in the form of a powder, sheet, porous body or mesh onto a sheet, porous body or a mesh of said further metal, or vice-versa.

16. The method of claim 15, wherein said intermetallic compound is obtained by heating the aluminium and said further metal on top of the cathode surface in the aluminium electrowinning cell to a sufficient temperature to initiate a reaction for the formation of said intermetallic compound, before or during preheating of the cell.

17. The method of claim 1, comprising applying at least one additional start-up layer on the cathode surface, said additional layer being obtained at least partly from a boron-containing solution forming a glassy layer.

18. The method of claim 17, wherein the boron-containing solution contains boron oxide, boric acid or tetraboric acid.

19. The method of claim 17, wherein the boron-containing solution comprises a boron compound dissolved in a solvent selected from methanol, ethylene glycol, glycerine, water and mixtures thereof.

20. The method of claim 1, comprising applying at least one additional start-up layer on the cathode surface, said additional layer being obtained at least partly from a polymer or a polymer precursor.

21. The method of claim 20, wherein the polymer is selected from polyurethane, ethylene glycol, polyethylene glycol, resins, esters or waxes.

22. The method of claim 1, comprising applying at least one additional start-up layer on the cathode surface, said additional layer being obtained at least partly from a solution comprising phosphates of aluminium.

23. The method of claim 22, wherein the phosphates of aluminium are selected from monoaluminium phosphate, aluminium phosphate, aluminium polyphosphate, aluminium metaphosphate and mixtures thereof.

24. The method of claim 1, comprising applying at least one additional start-up layer on the cathode surface, said additional layer being obtained at least partly from a colloid solution that gels during preheating.

25. The method of claim 24, wherein the colloid is selected from colloidal alumina, silica, yttria, ceria, thoria, zirconia, magnesia, lithia, monoaluminium phosphate, cerium acetate or mixtures thereof.

26. The method of claim 24, wherein the colloid is at least partly integrated into the cathode surface or an aluminium-wettable refractory coating on said surface.

27. The method of claim 24, wherein the colloid solution comprises a particulate conductor.

28. The method of claim 27, wherein the particulate conductor is selected from aluminium, nickel, iron, titanium, cobalt, chromium, zirconium, copper and combinations thereof.

29. The method of claim 1, comprising applying at least one additional start-up layer containing carbides and/or borides of metals, in particular of metals selected from the group comprising aluminium, titanium, chromium, vanadium, zirconium, hafnium, niobium, tantalum, molybdenum and cerium.

30. The method of claim 1, comprising applying at least one start-up layer containing particulate aluminium.

31. The method of claim 1, comprising applying at least one thick sheet of aluminium having a thickness of 1 to 5 mm on top of the start-up layer(s).

32. The method of claim 1, wherein each applied start-up layer is electrically conductive, the start-up layer(s) being covered with a layer of electrically conductive material, heat being generated by passing electric current via anodes, through the conductive material and the conductive start-up layer(s) into the cell bottom to heat the cell by the Joule effect.

33. The method of claim 32, wherein a relatively thick sheet or sheets of aluminium, usually from 1 to 5 mm thick, is placed between each anode and the start up layer.

34. The method of claim 33, wherein a relatively thick sheet or sheets of aluminium, usually from 1 to 5 mm thick, is placed on the start up layer.

35. The method of claim 32, wherein said conductive material contains coke.

36. The method of claim 1, wherein the cell bottom is flame preheated by burners.

37. The method of claim 1, wherein the cell bottom is preheated using infrared radiation.

38. The method of claim 37, wherein said fluoride-based is mixed with or covers a layer of conductive melt material such as coke.

39. The method of claim 1, wherein the or at least one start-up layer extends up the side walls of the cell.

40. The method of claim 39, wherein the or at least one start-up layer extends above the level of the fluoride-based melt during normal use of the cell.

41. The method of claim 1, wherein the or at least one start-up layer is applied on the cathode surface using painting methods, such as brushes, rollers or spraying.

42. The method of claim 1, comprising applying at least one start-up layer by hot-spraying molten metal.

43. The method of claim 1, comprising applying at least one start-up layer by CVD, PVD, plasma spraying, electrodeposition, chemical deposition, adhesive application or hot-pressing.

44. The method of claim 1, comprising applying the or at least one start-up layer with an automated or a partly automated system.

45. A method of electrowinning aluminium comprising a cell start-up procedure as described in claim 1 followed by producing aluminium by the electrolysis of alumina dissolved in a fluoride-based melt.

46. The method of claim 45, comprising operating the fluoride-based melt at a temperature comprised between 700° and 970° C.

47. The method of claim 45, comprising evolving oxygen on a non-carbon anode.

48. The method of claim 47, comprising operating the fluoride-based melt at a temperature comprised between 750° and 850° C.

49. The method of claim 45, comprising producing aluminium on an aluminium-wettable drained cathode.

* * * * *